US009010706B2

(12) United States Patent
Cheng

(10) Patent No.: US 9,010,706 B2
(45) Date of Patent: Apr. 21, 2015

(54) CURTAIN ROD ORNAMENTAL STRUCTURE

(71) Applicant: Li-Ming Cheng, Kaohsiung (TW)

(72) Inventor: Li-Ming Cheng, Kaohsiung (TW)

( * ) Notice: Subject to any disclaimer, the term of this patent is extended or adjusted under 35 U.S.C. 154(b) by 174 days.

(21) Appl. No.: 13/916,295

(22) Filed: Jun. 12, 2013

(65) Prior Publication Data

US 2014/0370236 A1 Dec. 18, 2014

(51) Int. Cl.
*A47H 1/142* (2006.01)
*A47H 99/00* (2009.01)

(52) U.S. Cl.
CPC ..... *A47H 99/00* (2013.01); *Y10T 428/24174* (2013.01)

(58) Field of Classification Search
CPC ..... A47H 1/142
USPC ..... 428/99, 119, 120; 248/261
See application file for complete search history.

(56) References Cited

U.S. PATENT DOCUMENTS 2,706,521 A * 4/1955 Nelson ..... 160/38

* cited by examiner

*Primary Examiner* — Alexander Thomas
(74) *Attorney, Agent, or Firm* — Muncy, Geissler, Olds & Lowe, P.C.

(57) ABSTRACT

A curtain rod ornamental structure comprises a first ornamental panel with a leaning member extended outwards from the back side, a second ornamental panel and a third ornamental panel symmetrically coupled on two sides of the first ornamental panel, a first edge covering member fastened to one side of the second ornamental panel and including a first fixing member opposing the leaning member, and a second edge covering member fastened to one side of the third ornamental panel and including a second fixing member opposing the first fixing member. Through the leaning member, first fixing member and second fixing member a curtain rod can be coupled and anchored. The first, second and third ornamental panels can cover and decorate the curtain rod to meet ornamental purpose and increase varieties to improve practicality.

7 Claims, 5 Drawing Sheets

CURTAIN ROD ORNAMENTAL STRUCTURE

FIELD OF THE INVENTION

The present invention relates to a curtain rod ornamental structure and particularly to an ornamental panel installed on an outer side of a curtain rod to provide covering and decoration.

BACKGROUND OF THE INVENTION

A conventional window covering usually is installed on a wall, a window frame or ceiling through a curtain rod or rack. The curtain rod runs through a plurality of hanging rings to hang a window shade at the bottom thereof. The window shade can be stretched to fully cover the window frame to block sunshine or serve decorative purpose.

However, the conventional curtain rod is made in a monotonous fashion without much variety. Moreover, the curtain rod generally is totally exposed to the wall, window frame or ceiling, and visible notably and unappealing. To remedy the aforesaid shortcomings by providing cover to improve appeal has to rely on professional help and construction. This could further mess the wall, window frame or ceiling, or experienced decoration professionals or interior designers have to be hired or contracted to do the work. It is expensive. Hence there are still a lot of rooms for improvement on the conventional curtain rod in terms of use and fabrication.

SUMMARY OF THE INVENTION

The primary object of the present invention is to overcome the problem of the monotonous conventional curtain rod of deficiency in variety by providing an improved curtain rod with a first ornamental panel, a second ornamental and a third ornamental panel incorporating with a first edge covering member and a second edge covering member to cover and decorate a monotonous curtain rod.

To achieve the foregoing object the invention provides a curtain rod ornamental structure which includes a first ornamental panel with a leaning member extended outwards from the back side that has an aperture run through by a curtain rod, a second ornamental panel and a third ornamental panel symmetrically coupled on two sides of the first ornamental panel, a first edge covering member fastened to one side of the second ornamental panel and including a first fixing member opposed the leaning member and contained a first sleeve on an inner side to couple with one end of the curtain end for anchoring, and a second edge covering member fastened to one side of the third ornamental panel and including a second fixing member opposed the first fixing member and also contained a second sleeve on an inner side thereof.

The curtain rod ornamental structure thus formed, with the first, second and third ornamental panels, the first edge covering member at one side of the second ornamental panel, the second edge covering member at one side of the third ornamental panel opposing the first edge covering member, and the leaning member at the first ornamental panel run through by the curtain rod with two ends thereof anchored on the inner sides of the first and second edge covering members, the first, second and third ornamental panels can serve decoration purpose and also cover the curtain rod, hence can overcome the drawbacks of the monotonous conventional curtain rod.

The foregoing, as well as additional objects, features and advantages of the invention will be more readily apparent from the following detailed description, which proceeds with reference to the accompanying drawings. The drawings serve merely for illustrative and discussion purpose and are not the limitation of the invention.

DETAILED DESCRIPTION OF THE PREFERRED EMBODIMENT

Figure 1:
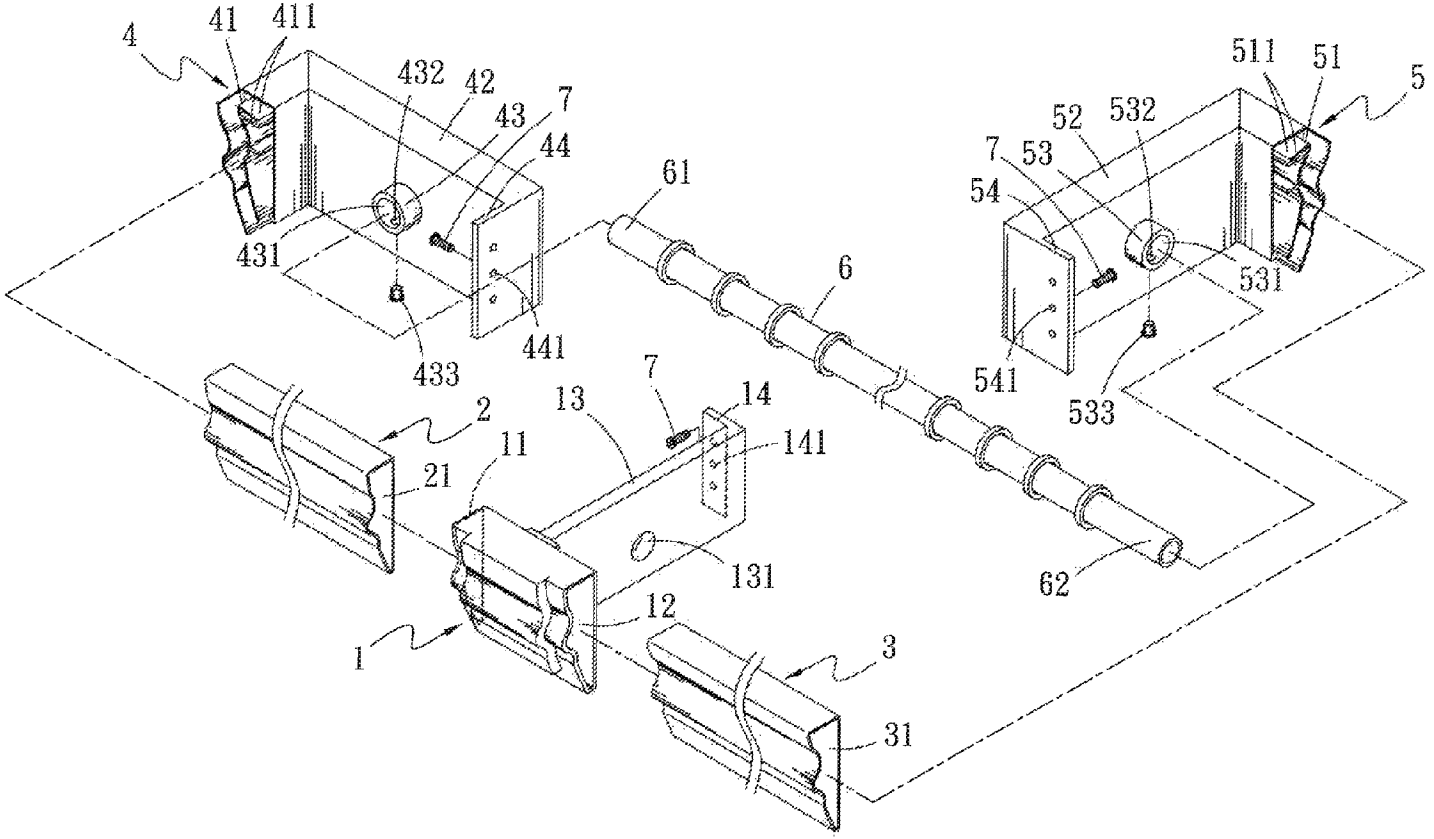
FIG. 1 is an exploded view of the invention.
Figure 2:
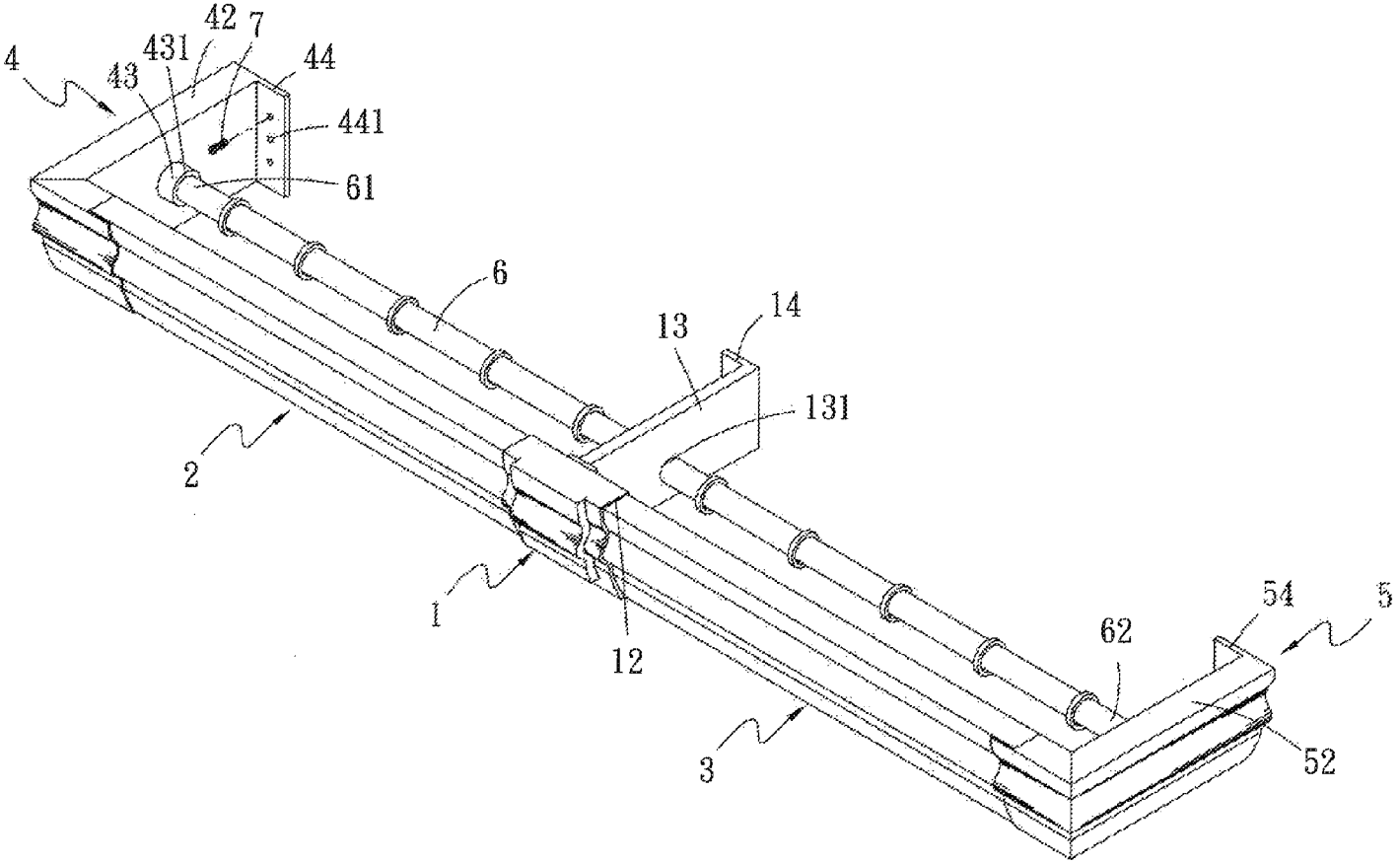
FIG. 2 is a perspective view of the invention.
Figure 3A:
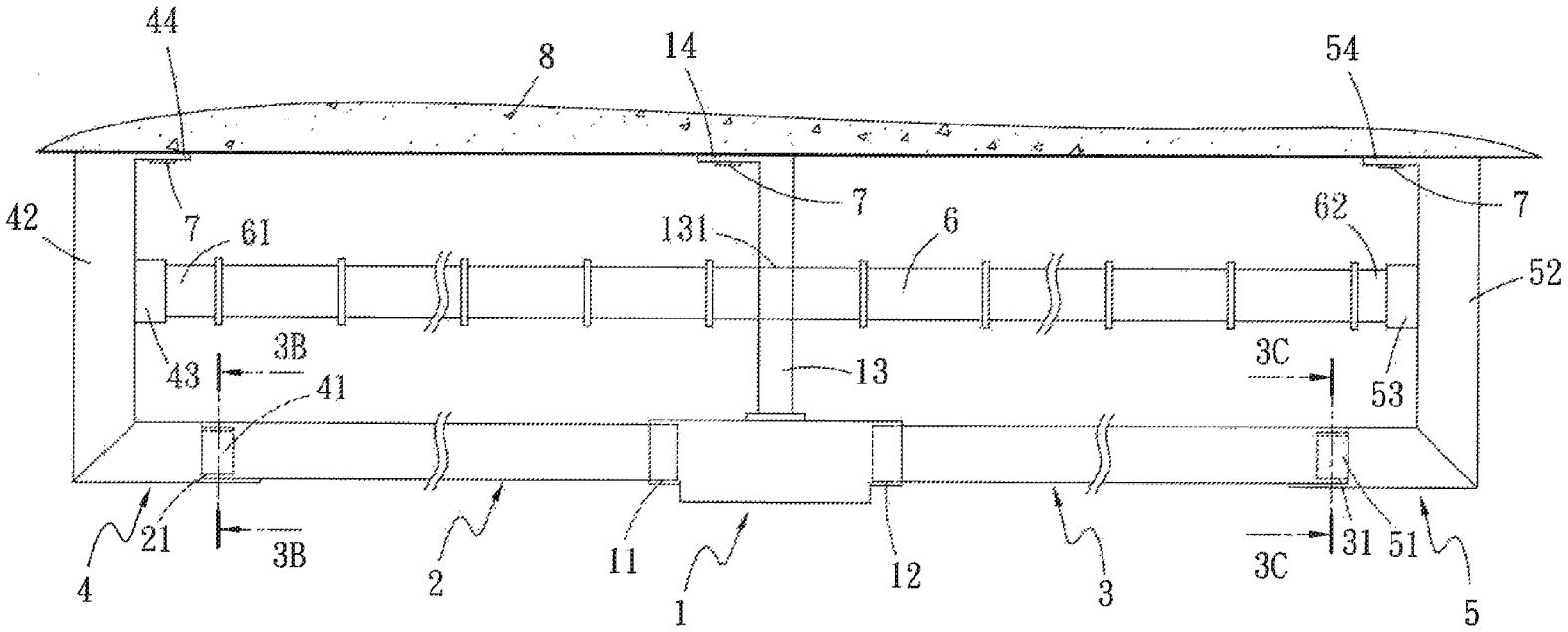
FIG. 3A is a top view of the invention.
Figure 3B:
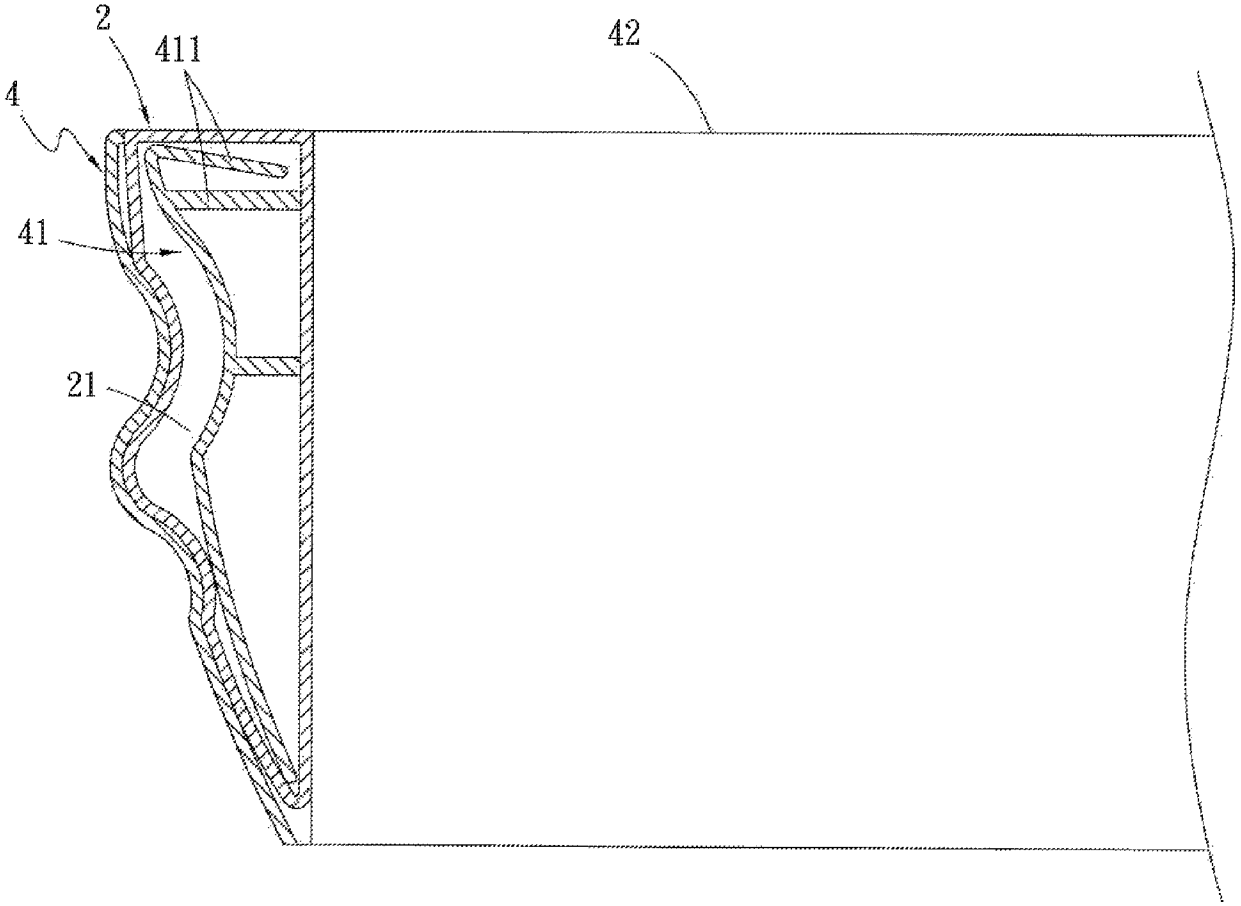
FIG. 3B is a cross section taken on line 3B-3B in FIG. 3A.
Figure 3C:
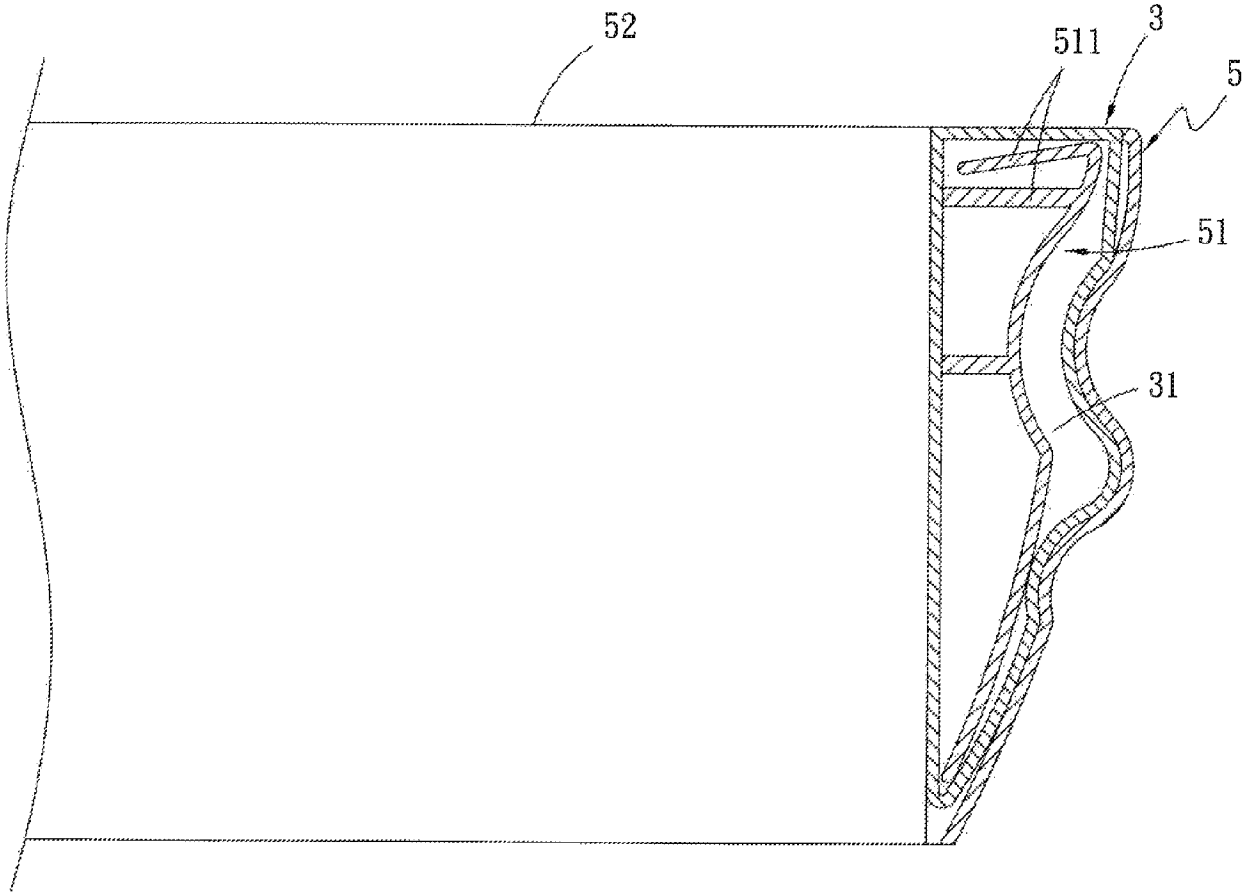
FIG. 3C is a cross section taken on line 3C-3C in FIG. 3A.

Please referring to FIGS. 1, 2 and 3A, the present invention aims to provide a curtain rod ornamental structure that comprises:

a first ornamental panel 1 which has first wedge troughs 11 and 12 at two sides and a leaning member 13 extended outwards from the backside. The leaning member 13 has an aperture 131 at a middle portion run through by a curtain rod 6. The leaning member 13 has a distal end bent to form a first anchor member 14 which has at least one anchor hole 141 run through by at least one fastening element 7 to anchor the leaning member 13 on a wall 8;

a second ornamental panel 2 which is formed in a shape same as the first wedge trough 11 at one side of first ornamental panel 1 and has a hollow second wedge trough 21 inside and one side wedged in the abutting first wedge trough 11 for anchoring;

a third ornamental panel 3 which is formed in a shape same as another first wedge trough 12 at another side of the first ornamental panel 1 and has a hollow third wedge trough 31 inside and one side wedged in the another abutting first wedge trough 12 for anchoring; thereby the first ornamental panel 1 has the two sides coupled respectively with the second ornamental panel 2 and third ornamental 3;

a first edge covering member 4, referring to FIG. 3B, which has a first wedge portion 41 at one side of the second wedge trough 21 and formed in the same shape thereof. The first wedge portion 41 has at least two butting edges 411 butting the second wedge trough 21 to form secure wedge therewith. The first edge covering member 4 has a first fixing member 42 opposing the leaning member 13 and having a first sleeve 43 extended from an inner side thereof. The first sleeve 43 has a first wedge opening 431 or a first hole 432 at the bottom to couple with one end 61 of the curtain rod 6, or be securely fastened thereof via a first screw 433 run through the first hole 432. The first fixing member 42 has a distal end bent to form a second anchor member 44 which has at least one second anchor hole 441 run through by at least one fastening element 7 to hold the second fixing ember 42 on the wall 8; and a second edge covering member 5, referring to FIG. 3C, which has a second wedge portion 51 at one side of the third wedge trough 31 and formed in the same shape thereof. The second wedge portion 51 has at least two butting edges 511 butting the third wedge trough 31 to form secure wedge therewith. The second edge covering member 5 has a second fixing member 52 opposing the first fixing member 42 and having a second sleeve 53 extended from an inner side thereof. The second sleeve 53 has a second wedge opening 531 or a second hole 532 at the bottom to couple with other end 62 of the curtain rod 6, or be securely fastened thereof via a second screw 533 run through the second hole 532. The second fixing member 52 has a distal end bent to form a third anchor member 54 which has at least one third anchor hole

541 run through by at least one fastening element 7 to hold the second fixing member 52 on the wall 8.

Referring to FIGS. 1, 2 and 3A, the invention, with the first wedge troughs 11 and 12 at two sides of the first ornamental panel 1 wedged respectively by one side of the second ornamental panel 2 and third ornamental panel 3, incorporated with the first edge covering member 4 at another side of the second ornamental panel 2 and the second edge covering member 5 at another side of the third ornamental panel 3 opposing the first edge covering member 4, the curtain rod 6 can run through the leaning member 13 of the first ornamental panel 1 with one end 61 held in the first sleeve 43 of the first edge covering member 4, and other end 62 held in the second sleeve 53 of the second edge covering member 5, thereby can be covered and decorated by the first, second and third ornamental panels 1, 2 and 3 to meet decoration purpose.

The first, second and third ornamental panels 1, 2 and 3 can be assembled and collaborated with the first and second edge covering members 4 and 5 in multiple sets as desired, and implemented substantially same as the embodiment shown in FIG. 1, details are omitted herein.

What is claimed is:

1. A curtain rod ornamental structure, comprising:

a first ornamental panel including a leaning member extended outwards from the backside thereof;

a second ornamental panel and a third ornamental panel symmetrically coupled with two sides of the first ornamental panel;

a first edge covering member which is located at one side of the second ornamental panel and coupled with the second ornamental panel, and includes a first fixing member opposing the leaning member; and a second edge covering member which is located at one side of the third ornamental panel and coupled there third ornamental panel, and includes a second fixing member opposing the first fixing member to allow a curtain rod to run through the leaning member with two ends thereof anchored on inner sides of the first fixing member and the second fixing member.

2. The curtain rod ornamental structure of claim 1, wherein the first ornamental panel includes first wedge troughs at two sides thereof, the leaning member including an aperture run through by the curtain rod which contains a distal end bent to form a first anchor member, the first anchor member containing at least one first anchor hole run through by at least one fastening element for anchoring thereof.

3. The curtain rod ornamental structure of claim 2, wherein the second ornamental panel is formed in a shape same as the first wedge trough at one side of the first ornamental panel and includes a hollow second wedge trough inside and is wedged in the first wedge trough through one side thereof abutting the one side of the first ornamental panel.

4. The curtain rod ornamental structure of claim 3, wherein the third ornamental panel is formed in a shape same as the first wedge trough at another side of the first ornamental panel and includes a hollow third wedge trough inside and is wedged in the first wedge trough through one side thereof abutting the another side of the first ornamental panel.

5. The curtain rod ornamental structure of claim 4, wherein the first edge covering member includes a first wedge portion at one side of the first edge covering member toward the second wedge trough and formed in the same shape thereof, the first wedge portion containing at least two butting edges butting the second wedge trough, the first edge covering member including a first fixing member extended from another side of the first edge covering member and opposed the leaning member, the first fixing member containing a first sleeve extended from an inner side thereof to couple with one end of the curtain rod, the first fixing member including a distal end bent to form a second anchor member which contains at least one second anchor hole run through by at least one fastening element for anchoring thereof.

6. The curtain rod ornamental structure of claim 5, wherein the second edge covering member includes a second wedge portion at one side of the second edge covering member toward the third wedge trough and formed in the same shape thereof, the second wedge portion containing at least two butting edges butting the third wedge trough, the second edge covering member including a second fixing member extended from another side of the second edge covering member and opposed the first fixing member, the second fixing member containing a second sleeve extended from an inner side thereof to couple with other end of the curtain rod, the second fixing member including another distal end bent to form a third anchor member which contains at least one third anchor hole run through by at least one fastening element for anchoring thereof.

7. The curtain rod ornamental structure of claim 6, wherein the first ornamental panel, the second ornamental panel and the third ornamental panel are incorporated with the first edge covering member and the second edge covering member and formed in multiple sets for assembly together.

* * * * *